US009987650B2

(12) United States Patent
Gillest et al.

(10) Patent No.: US 9,987,650 B2
(45) Date of Patent: Jun. 5, 2018

(54) SPRAY GUN MOUNT AND RETROFIT KIT

(71) Applicant: Integrated Packaging Solutions, LLC, Wheatridge, CO (US)

(72) Inventors: Kevin Michael Gillest, Arvada, CO (US); Michael W. Calahan, Arvada, CO (US); Kalvis Jaunarajs, Littleton, CO (US); Byron Henze, Idaho Springs, CO (US)

(73) Assignee: Integrated Packaging Solutions, Wheat Ridge, CO (US)

( * ) Notice: Subject to any disclaimer, the term of this patent is extended or adjusted under 35 U.S.C. 154(b) by 282 days.

(21) Appl. No.: 14/792,483

(22) Filed: Jul. 6, 2015

(65) Prior Publication Data

US 2017/0008020 A1 Jan. 12, 2017

(51) Int. Cl.

| | |
|---|---|
| ***B05B 13/04*** | (2006.01) |
| ***B05B 13/06*** | (2006.01) |
| ***B05B 15/08*** | (2006.01) |

(52) U.S. Cl.

CPC ..... *B05B 15/08* (2013.01); *B05B 13/06* (2013.01); *B05B 13/0645* (2013.01)

(58) Field of Classification Search

CPC ..... B05B 13/0278; B05B 13/0421; B05B 13/0431; B05B 13/06; B05B 13/0618; B05B 13/0627; B05B 13/0636; B05B 13/0645; B05B 15/08

See application file for complete search history.

(56) References Cited

U.S. PATENT DOCUMENTS

| | | | | |
|---|---|---|---|---|
| 4,378,959 A * | 4/1983 | Susnjara | B05B 13/0431 414/732 |
| 4,526,128 A | 7/1985 | Sorace et al. | |
| 4,592,495 A * | 6/1986 | Toda | B05B 13/0431 222/146.5 |
| 2016/0067732 A1* | 3/2016 | Nakamura | B05B 13/0405 427/427.2 |

FOREIGN PATENT DOCUMENTS

| | | | |
|---|---|---|---|
| CN | 101712157 A * | 5/2010 | |
| WO | WO-2003097252 A1 | 11/2003 | |
| WO | WO-2014147163 A1 | 9/2014 | |

* cited by examiner

*Primary Examiner* — Darren W Gorman

(74) *Attorney, Agent, or Firm* — Thomas E. Jurgensen; Craig W. Barber

(57) ABSTRACT

A spray gun mount, and retrofit kit spray gun mount based thereon, and a method of retrofitting, adjusting and spraying based thereon, are structured that the motion of the spray gun occurs about a point of rotation located at the exact nozzle of the spray gun rather than at a location on the gun mount. An arcuate slot may be provided on a fixed mounting plate and extensions (partially threaded screws) pass through the arcuate slot. The extensions in turn are firmly attached to a movable gun mount plate to which the spray gun is affixed. In adjusting the spray gun, all that may be necessary is to loosen a fastener which holds the gun mount plate and gun from rotating relative to the fixed plate, rotating it relative to the fixed plate and fastening it back into place again.

1 Claim, 4 Drawing Sheets

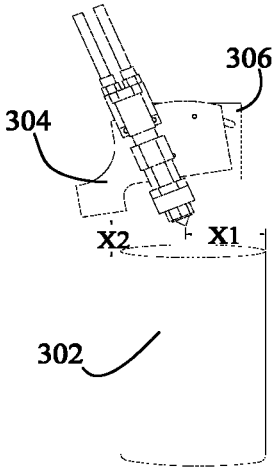
Figure 3
Figure 4
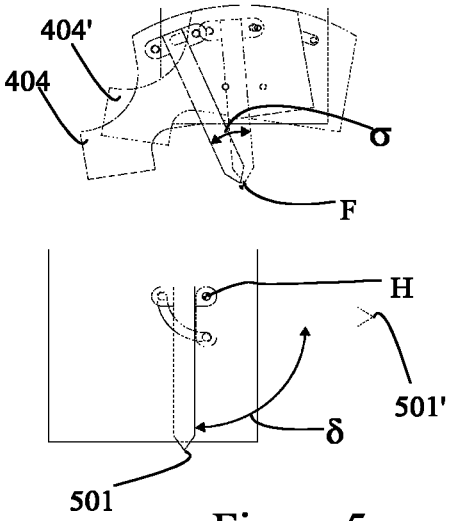
Figure 5
PRIOR ART

SPRAY GUN MOUNT AND RETROFIT KIT

CROSS-REFERENCE TO RELATED APPLICATIONS

N/A

FIELD OF INVENTION

This invention relates generally to spray application and specifically to spray coatings of interior surfaces of cylindrical items, for example in traditional can/containers coating machines.

STATEMENT REGARDING FEDERALLY FUNDED RESEARCH

This invention was not made under contract with an agency of the US Government, nor by any agency of the US Government.

BACKGROUND OF THE INVENTION

Modern coating applications of the interiors of objects relies upon spray gun technology. A typical spray gun that has a barrel, has a nozzle at the lower end and a feed mechanism at the upper end, often a body which is part of a recirculating loop of paint, lacquer or other coating.

Traditionally, the cans/containers descend in a track into a rotating star wheel, which is oriented vertically. As the star wheel rotates, the cans/containers pass in front of the spray gun, which has been adjusted for the size and shape of cans/containers being sprayed, and the spray gun is activated by automated controls for a brief period of time (some milliseconds) during which it coats the interior of the can/containers. The process continues during a production run (or during several shifts or several days) and coats the interior of hundreds/thousands of cans/containers per minute. Various means and methods might be employed to speed up the act of spraying the can/containers during a run, however, the present invention is not directed at that. This invention is instead to the industrial process of adjusting the spray guns between production runs.

In most instances, adjusting spray guns requires an iterative process, partially science and partially trial-and-error, due to the broad array of can shapes and sizes and the wide range of possible adjustments therefrom.

In most prior art, a spray gun is mounted so that it can be adjusted in three dimensions. The three degrees of freedom are vertical and horizontal linear changes (two degrees of translation) and a rotation of the spray gun about the mount (one degree of rotation). The problem may be seen in exaggerated and simplified form in PRIOR ART FIG. 5.

PRIOR ART FIG. 5 shows a spray gun and mount and a range of motion in rotation. It may be seen that when the spray gun in the first position 501 may be rotated by a sweep angle * and becomes the spray gun in the second position 501', it rotates about a focal point H. Point H is determined, of course, for engineering convenience in designing the gun mount. (Note that the gun 501 is simplified and the sweep angle * is vastly exaggerated for clarity.)

Examining PRIOR ART FIG. 5 it may be seen that the gun nozzle is in a different physical location. Thus, while the gun nozzle has been adjusted in angular measure (rotated) it has now moved (translated) to a new location.

However, the traditional vertical star wheel does not compensate for this motion: the pocket holding the cans to be sprayed will still be located and oriented in the same place as always.

This means that the operators must now adjust the gun a second time, this time in two dimensions of translation, in an attempt to properly locate the gun nozzle. However, the spray pattern made by the gun may change when it is moved, requiring a repetition of the original step of adjusting the angle. This may then require another adjustment in location and so on.

In practice, the location may be likely to be adjusted first, setting off the same cycle. This process can take a considerable amount of time, depending upon the individual adjusting the nozzle.

Since the can/container may be possibly to be used for food or beverage products, such as aluminum or steel beverage cans, regulations or the spray gun manufacturer may require some form of certification/documentation of the actual positioning of the gun after each adjustment, prior to beginning a production run.

It would be preferable to provide a spray gun mount which avoids these problems, difficulties and inefficiencies of adjustment between production runs.

SUMMARY OF THE INVENTION

The present invention teaches a spray gun mount, and a retrofit kit spray gun mount based thereon, and a method of retrofitting, adjusting and spraying based thereon, which are structured so that the motion of the spray gun occurs about a point of rotation located at the exact nozzle of the spray gun rather than at a location on the gun mount.

In one embodiment, an arcuate slot or other motion control structure may be provided on a fixed mounting plate. The mounting plate does not move, however, extensions (partially threaded screws or the like) pass through the arcuate slot and may move therein. The extensions in turn are firmly attached to a movable gun mount plate to which the spray gun is affixed. In adjusting the spray gun, all that may be necessary may be to loosen a fastener which holds the gun mount plate and gun from rotating relative to the fixed plate, rotating it relative to the fixed plate and fastening it back into place again.

One important structure of the invention may be the shape and radius of the arcuate slot. In particular, the slot (a conic section arc) defines a focal point which may be chosen to coincide fairly closely with the exact nozzle end of the spray gun. Thus, when the gun is rotated, the arcuate slot structure forces it to rotate about the nozzle end. This in turn means that adjusting the angle of the gun has no effect on the vertical and horizontal displacement of the gun from the work piece to be coated/sprayed.

In a retrofit embodiment, the fixed plate, gun mounting plate, fastener, extensions and screws for securing the spray gun thereto may be provided.

In a method embodiment, the user may remove the spray gun from the traditional spray machine (or from other machines, now known or later invented) and assemble the mounting kit onto the machine, reattaching the spray gun to the movable gun mount plate. Then the user may simply adjust the angle for each run without adjusting the spray gun in translation, or when adjusting the angle of the gun may do so without complicating an additional adjustment in translation (location). The iterative process of trial-and-error is thus avoided or greatly reduced.

These and many other aspects, advantages, embodiments and objectives of the present invention will be understood by reference to the following.

SUMMARY IN REFERENCE TO THE CLAIMS

It is therefore one aspect, advantage, objective and embodiment of the present invention, in addition to those described above, to provide a sprayer for coating the inner surface of a cylindrical item of manufacture, the sprayer comprising: a generally cylindrical spray gun barrel having a nozzle end and a second rear end to receive a coating such as lacquer, the spray gun barrel having a longitudinal axis, a first extension projecting from the spray gun barrel; the length of the longitudinal axis from the nozzle end to the first extension being L; a first slot, the first slot generally arc shaped, the arc of the first slot defining a plane P of the arc, the arc shaped slot defining a focus F of the arc lying in the plane P of the arc, the arc radius R being equal to L; the first extension passing through the first slot, and the longitudinal axis of the spray gun held parallel to the plane P of the arc at an offset distance O, whereby the nozzle end is held orthogonally offset from the focus F in the plane P by the distance O; a fastener dimensioned and configured to physically engage the spray gun and in a first (secured) mode hold the spray gun barrel extension locked in place in the first slot whereby the spray gun barrel is held in an alignment with the first slot and the nozzle end is held in place; the fastener dimensioned and configured to, in a second (free) mode, allow the spray gun extension to travel within the first slot, whereby the spray gun barrel alignment with the first slot may change but the spray gun nozzle remains held in place while the rear end of the spray gun barrel sweeps through an angle σ.

It is therefore one aspect, advantage, objective and embodiment of the present invention, in addition to those described above, to provide a sprayer, further comprising: a fixed mounting plate, the first slot in the mounting plate, the mounting plate in the plane P.

It is therefore one aspect, advantage, objective and embodiment of the present invention, in addition to those described above, to provide a sprayer, further comprising: a gun mounting plate, the gun mounting plate attached to the spray gun barrel, the gun mounting plate parallel and adjacent to the fixed mounting plate, the fastener engaging in the first (secured) mode to hold the fixed mounting plate and the gun mounting plate locked in place, the gun mounting plate and the fixed mounting plate able to slide relative to one another when the fastener is in the second (free) mode.

It is therefore one aspect, advantage, objective and embodiment of the present invention, in addition to those described above, to provide a sprayer, further comprising: a feed-body portion of the spray gun barrel, the gun mounting plate attached to the spray gun barrel at the feed-body.

It is therefore one aspect, advantage, objective and embodiment of the present invention, in addition to those described above, to provide a sprayer, further comprising: a back plate fastened to the fixed mounting plate and covering the first slot, whereby any overspray from the sprayer cannot enter the first slot.

It is therefore one aspect, advantage, objective and embodiment of the present invention, in addition to those described above, to provide a sprayer, wherein the extension further comprises an unthreaded part passing through the fixed mounting plate.

It is therefore one aspect, advantage, objective and embodiment of the present invention, in addition to those described above, to provide a sprayer, wherein the extension further comprises a threaded part attaching the extension to the gun mounting plate.

It is therefore one aspect, advantage, objective and embodiment of the present invention, in addition to those described above, to provide a sprayer, wherein the fastener further comprises: a spring-loaded pin having a grip part at a first end and a pin part at a second end, the second end projecting from the backplate, the first end passing through the fixed mounting plate and into one of a plurality of apertures in the gun mounting plate, the spring-loaded pin urged by the spring into the one of the plurality of apertures and thus into the first (secured) mode, except when the grip part is pulled away from the gun mounting plate and thus into the second (free) mode.

It is therefore one aspect, advantage, objective and embodiment of the present invention, in addition to those described above, to provide a sprayer, the grip part further comprising a ring.

It is therefore one aspect, advantage, objective and embodiment of the present invention, in addition to those described above, to provide a retrofit kit retrofit kit for a spray gun having a generally cylindrical spray gun barrel having a first nozzle end and a second rear end (feed body portion) to receive a coating such as lacquer, the spray gun barrel having a longitudinal axis, the retrofit kit comprising: a fixed mounting plate have a plane P, the fixed mounting plate having therein a first slot, the first slot generally arc shaped, the arc of the first slot defining a focus F of the arc lying in the plane P of the fixed mounting plate; a first extension passing movably through the first slot and secured to such spray gun barrel, such longitudinal axis of such spray gun barrel held parallel to the plane P of the fixed mounting plate at an offset distance O; whereby such nozzle end is held orthogonally offset from the focus F by the offset distance O; a fastener dimensioned and configured to physically engage such spray gun barrel and in a first (secured) mode hold such spray gun barrel locked in place whereby such spray gun barrel is held in an alignment with the first slot and such nozzle end is held in place; the fastener dimensioned and configured to, in a second (free) mode, allow such spray gun extension to travel within the first slot, whereby such spray gun barrel may rotate relative to the fixed mounting plate, but such spray gun nozzle remains held in place while such rear end of such spray gun barrel sweeps through an angle σ.

It is therefore one aspect, advantage, objective and embodiment of the present invention, in addition to those described above, to provide a retrofit kit further comprising: a gun mounting plate, the gun mounting plate attached to such spray gun barrel, the gun mounting plate parallel and adjacent to the fixed mounting plate, the fastener engaging in the first (secured) mode to hold the fixed mounting plate and the gun mounting plate locked in place, the gun mounting plate and the fixed mounting plate able to slide relative to one another when the fastener is in the second (free) mode.

It is therefore one more aspect, advantage, objective and embodiment of the present invention, in addition to those described above, to provide a retrofit kit, further comprising: a back plate fastened to the fixed mounting plate and covering the first slot, whereby any overspray from such spray gun barrel cannot enter the first slot.

It is therefore one more aspect, advantage, objective and embodiment of the present invention, in addition to those described above, to provide a retrofit kit, wherein the extension further comprises an unthreaded part passing through the fixed mounting plate.

It is therefore one more aspect, advantage, objective and embodiment of the present invention, in addition to those described above, to provide a retrofit kit, wherein the extension further comprises a threaded part attaching the extension to the gun mounting plate.

It is therefore one more aspect, advantage, objective and embodiment of the present invention, in addition to those described above, to provide a method of adjusting a spray gun having a nozzle end and a rear end (feed body portion), the method comprising: maintaining such nozzle end fixed in a first location defined by a vertical coordinate X1 and a horizontal coordinate X2; rotating such spray gun about the first location (X1, X2) whereby: such rear end (feed body portion) moves in space while such nozzle end remains at the first location (X1, X2).

BRIEF DESCRIPTION OF THE DRAWINGS

FIG. 3 is a frontal view, very slightly elevated, of the invention with a cylindrical body (for example, a can) being internally coated.

FIG. 4 is a partially transparent frontal view of the gun mount of the present invention showing the spray gun barrel sweeps through an angle σ.

FIG. 5 is a PRIOR ART gun mount shown reduced to simplest principles.

INDEX OF REFERENCE NUMERALS

Figure 1:
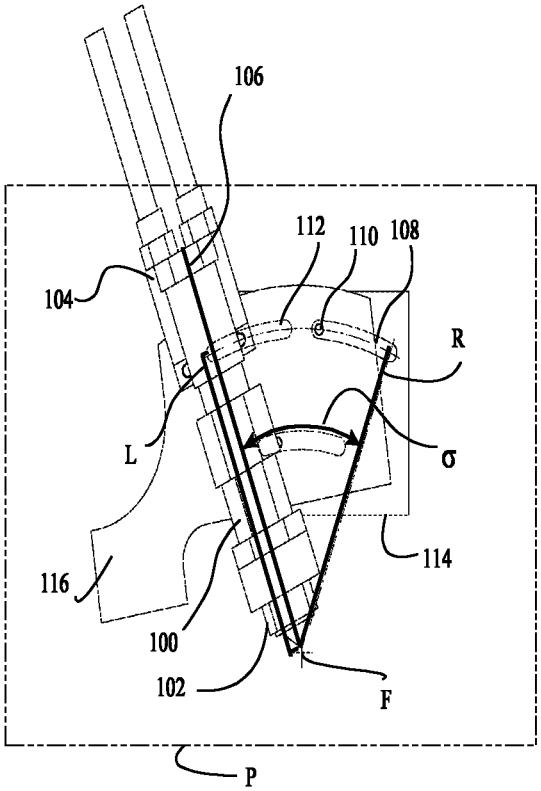
FIG. 1 is a front side view of a spray gun, and gun mount according to the gun mount of the present invention.

Spray gun barrel 100
Nozzle/nozzle end of barrel 102
Rear end/feed-body of barrel 104
Longitudinal axis 106
Arcuate slot 108
First extension (partially threaded screw) 110
Second arcuate slot 112
Fixed plate 114
Gun mounting plate 116
Can/cylindrical item/work piece 302
Gun mount plate 304
Fixed plate 306
Gun mount plate in first position 404
Gun mount plate in second position 404'
Nozzle in first position PRIOR ART 501
Nozzle in second position PRIOR ART 501'
Extension (partially threaded screw) 602
Fastener pin 604
Fastener spring 606
Fastener ring 608
Back plate/seal 610
Fastener hole (back plate) 612
Fastener hole (fixed mounting plate) 614
Fixed mounting plate 616
Gun mount plate 618
Arcuate slot in fixed mounting plate 620
Feed-body 624
Rear end of barrel 626
Barrel 628
Dismount gun from 3 dimensional mount 1002
Remount w/arcuate slot and focal nozzle 1004
Adjust rotating about focal point/nozzle 1006
Spray 1008
Horizontal measurement nozzle-can X1
Vertical measurement nozzle-can X2
Plane of gun mounting plate/motion P
Focal point of arc/center of rotation F
Radius of arc R
Barrel length: nozzle to extension L
Center of rotation PRIOR ART H
Offset from plane O
Sweep angle of barrel σ
Sweep angle of nozzle PRIOR ART *

DETAILED DESCRIPTION

Glossary

As used herein a cylindrical item of manufacture may refer to any object such as a package for a consumer good, which has a generally cylindrical body with an open end (the open end may only be present briefly during manufacture before being closed) and which requires coating, lacquer or painting on the inside/interior surface. Examples include aluminum and steel cans (for beverages or food) but may include any item, made of metal or polymer, which may be coated internally.

A spray gun barrel is the pressure spray part of a spray machine which actually ejects paint, lacquer or coating in the form of a spray of very fine droplets. Generally, the spray gun barrel will have an overall cylindrical configuration with numerous indents, furls, additions and so on, particularly including a feed-body near the rear end, the feed bod being the port, chamber, block, or structure which accepts liquid spray material into the cylindrical body from a feed source. The feed source may be a recirculating loop containing the material or may be a one way feed line (recirculation being quite common in can coating processes). The spray gun barrel will have a nozzle and/or nozzle end, usually the end closest to the cylindrical item of manufacture, which reduces the liquid flowing inside the barrel to a fine spray of droplets of the liquid, for example, by "atomizing" (which term has little to do with actual atoms) the liquid.

The spray gun barrel, being generally cylindrical, will have a longitudinal axis. This longitudinal axis may be measured in several ways without detracting from the scope of the present invention or departing from the ordinary mathematical terminology for an axis of a cylinder. It may be measured to several different lengths, for example, the entire length of the spray gun barrel might be used, however, for purposes of the present invention the term "the length of the longitudinal axis from the nozzle end to the first extension being L" indicates, that a measurement may be made along the longitudinal axis but not necessarily including the entire length of the spray gun barrel, unless the extension may be located at the far (distal) end from the nozzle.

An extension as used herein may refer to a post, a pin, a flange, a bolt, or any other projection which may extend through a slot in the fixed mounting plate and then may run in the slot. Similarly, bearings of various types, rails, tracks, and so on may function as the slot & extension of the invention.

An arc carries the ordinary definition of a segment of the perimeter of a conic section, that is, a part of a circle or ellipse. Such an arc defines a focus: a center of a circle or a focus of an ellipse, parabola and so on. An arc shaped slot is thus a two dimensional shape located in a plane defined by the plate/block having the slot therethrough. More broadly, a variety of structures may fall within the definition of a "slot" and a "extension". For example, a bearing-like extension and a race, a groove and tongue, a rail and trapped wheel or tab and more may all be generally described as a slot and an extension.

A plate may be any substantially flat body, or may refer to a thicker body such as a block.

A fastener as defined herein may be any mechanism which secures two plates or blocks from rotating relative to one another. Thus, a wing nut which tightens on a bolt and clamps two plates would be a perfectly acceptable fastener within the scope of the claims, as would a clamp or detent or block or numerous other structures. The presently preferred embodiment of a spring-loaded pin which seats into one of a multiplicity of possible holes may be merely one type of fastener and the invention is not so limited.

As used herein a retrofit kit refers to the invention provided without the entire spray machine, perhaps without even the spray gun in the best mode now contemplated. A retrofit kit offers low cost and easy upgradability to owners of machines with traditional 3 dimensional mounts.

Geometrical terms used herein have their normal mathematical meanings. While the structures of the invention can be claimed without reference thereto, the use of such geometrical terms provides clarity regarding the structures, for example, about the exact shape of arcuate slots, the nature of spray gun mounts and so on.

Glossary End

Figure 2:
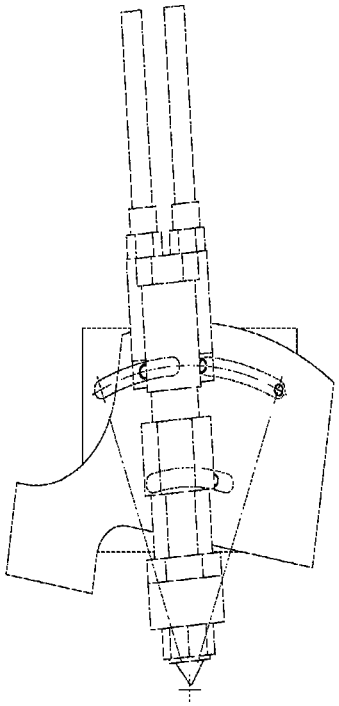
FIG. 2 is a front view of the spray gun adjusted to a slightly different angle on the gun mount but with the nozzle still in the same place as in FIG. 1.

FIG. 1 is a front side view of a spray gun, and gun mount according to the gun mount of the present invention. FIGS. 1 and 2 describe lengths and relationships which determine the structures of the invention.

Spray gun barrel 100 may be any typical spray gun made by various manufacturers, already installed, on the market, or later developed. Generally, but not necessarily, it may be a cylindrical hollow body having a nozzle/nozzle end 102 of the barrel 100. The nozzle 102 will have a jet from which the spray, coating, lacquer, etc. will be ejected, often in a generally conical shape, but specialty nozzles may spray in a different or even non-symmetrical pattern or may have various spray patterns depending upon other settings and nozzle design. The present invention may in general be adapted, if desirable, to work with typical guns and nozzles.

Rear end/feed-body portion of barrel 104 may be the location at which the recirculating liquid loop which provides the coating/paint/lacquer liquid meets the gun. The invention may also be used with one-way feed lines. In the best mode presently contemplated the feed-body 104 may be a convenient location for fasteners to the gun mount plate 116, however, this may be altered in other embodiments without departing the scope of the invention.

Longitudinal axis 106 may exist even if the gun barrel may be not an exact cylindrical body: the spray point (jet or nozzle tip) and the point at which the spray gun has an extension passing through an arced slot 108 or equivalent structure can define the axis on barrels of irregular shape.

Arcuate slot 108 may be important for controlling the motion of the spray gun so that spray gun barrel nozzle 102 remains in a single stationary point. By creating a structure which allows the gun barrel 100 to rotate while the nozzle 102 remains in place, the arcuate slot 108 (or track, rail, bearing, groove, etc.) allows for vastly simplified spray gun adjustment.

First extension 110 may be presently a post which has an unthreaded portion and a threaded portion at the end, equivalently a partially threaded screw or bolt. The extension 110 rides within (and in the present embodiment, may be trapped within) the motion control structure (arced slot/rail/etc.).

Second arcuate slot 112 and a second extension may also be provided for stability and durability.

A fixed screw to the gun mounting plate 116 may be actually any type of fastener which holds the gun mounting plate 116 to the spray gun barrel 100: the gun barrel need not rotate with reference to the gun mounting plate 116 but instead rotates (along with the gun mount plate 116) with reference to the fixed plate 114. Thus the fixed screw may be an attachment to the barrel, not the extension which cooperates with the motion control structure (slot, etc.).

Gun mounting plate 116 and fixed block 114 should be free to move with reference to one another. In aid of stability and accuracy, these are in the presently preferred embodiment adjacent and touching, however, alternative embodiments within the scope of the invention these may be reduced or even deprecated in favor of stronger motion control structures 108 and 110.

Plane of gun mounting plate/plane of motion P has therein focal point of arc/center of rotation F, however, there may be actually an offset from the plane (O), which offset O is not visible in FIG. 1 (but may be seen later in reference to FIG. 6). The offset may be not necessary but may be presently merely the distance from the plates to the center of the jet/nozzle 102.

It may instantly be seen that the radius of the arc, R, may be deliberately planned to be the same distance as the barrel length L defined to run from the nozzle to the extension.

Finally, a sweep angle of barrel ($\sigma$) is visible, however, it may be significant that this angle may be defined around the nozzle at focus F, whereas in prior art spray guns (as discussed later in reference to FIG. 5) a sweep angle would be defined about some point on the mounting.

Thus FIG. 2 is a front view of the spray gun adjusted to a slightly different angle on the gun mount but with the nozzle still in the same place as in FIG. 1. After being swept somewhat, the barrel has moved substantially, but the nozzle remains right at F, drastically simplifying the process of adjustment between runs.

FIG. 3 is a frontal view, very slightly elevated, of the invention with a cylindrical body (for example, a can) being internally coated.

Can/cylindrical item/work piece 302 may be shown vertically oriented, although it is more likely to be horizontal in practice as the installed base of machines have horizontally oriented cans at the moment of spraying. Regardless, the gun mount of the present invention can be used in any orientation.

Fixed plate 306 is seen with gun mount plate 304, which holds the spray gun barrel, terminating in the nozzle.

The nozzle can be measured in reference to the location of the lip of the can, with two measurements: horizontal measurement (nozzle to can) X1 and vertical measurement (nozzle to can) X2. While additional measurements could be employed, these two measures are sufficient to demonstrate the superiority of the present invention in ease of use. When the spray gun barrel of the present invention may be rotated about the nozzle tip, measurements X1 and X2 will not change. Obviously, the user may alter these as desired, however, it may be no longer mandatory to change these settings when the angle may be changed. IN addition, it may be anticipated that for a percentage of changes, possibly a majority of changes, it will not even be necessary to make vertical and horizontal adjustments to X1 and X2.

FIGS. 4 and 5 may be contrasted to understand the reasons for the selected structures.

FIG. 4 is a partially transparent frontal view of the gun mount of the present invention showing the spray gun barrel sweeps through an angle σ.

Gun mount plate may be seen in first position 404 and then after it has swept or subtended angle σ it may be instead in second position 404'. However, the nozzle remains in place even though the spray gun may now create a different spray pattern, for example to coat the interior of a different shape of container.

FIG. 5 is a PRIOR ART gun mount shown reduced to simplest principles. Nozzle in first position 501 is rotated through a sweep angle of * to second position 501'. This rotation is centered about point H, an hinge or the like. The result is that the nozzle ends in second position 501'. Any X1 and X2 measuring the location of the nozzle would be drastically different before and after these changes. While the angle and thus displacement of the nozzle have been exaggerated it may be seen that the angular change in the PRIOR ART mechanism now REQUIRES offsetting changes in location to compensate.

Figure 6:
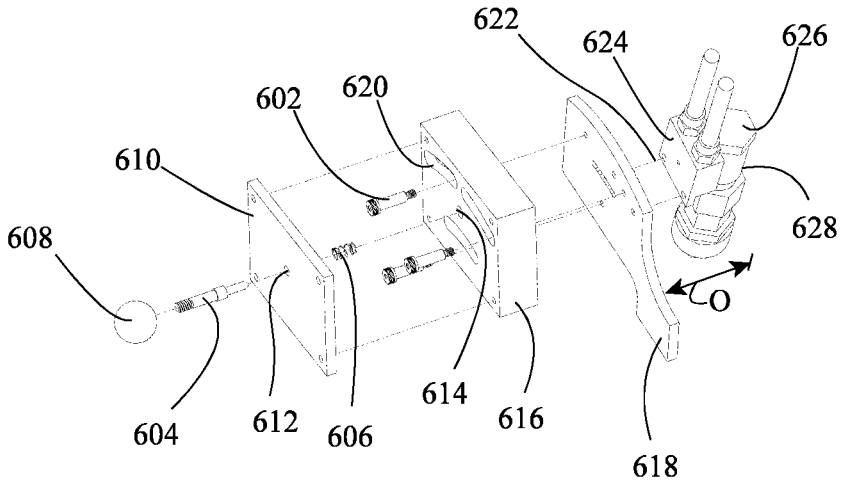
FIG. 6 is an exploded view of the gun mount and gun mount retrofit kit components of the present invention.

FIG. 6 is an exploded view of the gun mount and gun mount retrofit kit components of the presently preferred embodiment and best mode now contemplated for the present invention.

Extension (in this case a partially threaded screw or post) 602 will pass through the fixed block 616 trapped within the arcuate slot 620. The extension may be seen to have a head on the reverse side of the fixed mounting plate 616 which holds the two plates in a smooth alignment and prevents the extension from passing through the slot. The extension and slot can as easily be a trapped wheel on a rail, a race having a bearing-like structure trapped therein and so on, the terms extension and slot are obviously broad and describe various structures having additional details.

Fastener pin 604 may be the fastener which prevents unwanted motion within the slot: when the gun barrel has been adjusted properly, fastener pin 604 will hold it in angular alignment.

Fastener spring 606 urges the fastener pin 604 into engagement with one of the holes on the gun mount plate 618 which are dimensioned and configured to receive it.

Fastener ring 608 on the other hand allows a pull to be exerted against the fastener spring 606 whereby the fastener pin 604 may be withdrawn from the selected hole, the gun angle adjusted, and then the fastener ring freed so the fastener spring 606 once again seats the fastener pin and secures the two plates 616 and 618 back into non-rotating mode.

Back plate/seal 610 may be important for preventing fouling of the arcuate slots, and extensions, particularly more complex slots and extensions such as bearings or the like. In a typical spray machine environment an enormous amount of overspray occurs and the overspray droplets of liquid may easily float in the air and lodge in the mount mechanism, where it can then do what the liquid is designed to do: harden. This back plate 610 seals the mechanism on this side and reduces this problem.

Fastener hole (back plate) 612 and fastener hole (fixed mounting plate) 614 allow the fastener to pass through so that it may be accessed at one end by a user and may seat into the gun mount plate 618 when needed.

Fixed mounting plate/block 616 and gun mount plate 618 may, as noted earlier, be smaller structures such as a few supports, posts, etc., in embodiments in which the motion control structures 620 & 602 are more involved and able to, by themselves, maintain the spray gun in alignment both in production and during mutual rotation. However, the double plate system, with the sides of the plates sliding across one another during rotation, is simple and stable and thus presently preferred.

Arcuate slot in fixed mounting plate 620 cooperates with the extension 602 (whatever their detailed nature may be) to control the relative motions of the two plates 616/618. The plates should move in/parallel to a single plane of rotation and should furthermore maintain rotation only about point F.

Screw (gun mount plate to gun) 622 allows retrofitting, or original equipment fitting, of the spray gun to the movable gun mount plate. The gun does not rotate relative to this plate.

Feed-body 624 as noted previously is for feeding of liquid to the spray gun, however, it makes a convenient mounting location for the screws 622.

Rear end of barrel 626 and barrel 628 are as shown.

Offset from plane O merely indicates that the actual point F is located at the nozzle and is properly considered orthogonal to the plane P in which the arced motion control mechanisms move.

Figure 7:
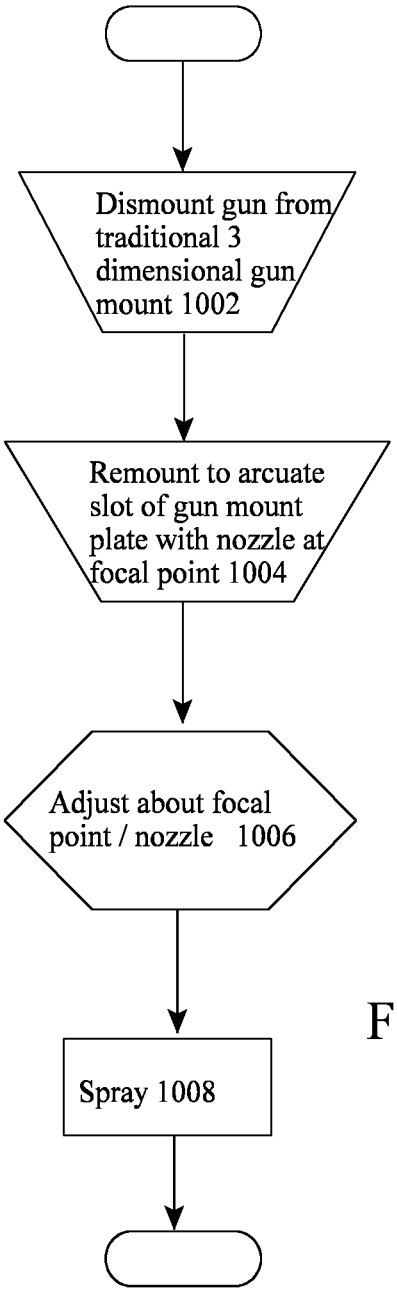
FIG. 7 is a simplified flow chart showing the steps of the present invention.

FIG. 7 is a simplified flow chart showing the steps of the present invention. In general, the first step may be to dismount the gun from the traditional 3-dimensional mount 1002. The gun itself may or may not be replaced, but in general it may be probable that users will simply continue using the same gun, pointing horizontally sideways at the pocket of the same preinstalled machine with the same vertical star wheel (or whatever orientation of star wheel and gun the machine already has anyway).

The second step would be to remount the machine with the w/arcuate motion controller (slot and extension, bearing and race, wheel and rail, or whatever) and thus obtain nozzle 1004 being placed at the focal point of an arc in which the gun may be adjusted.

Adjust rotating about focal point/nozzle 1006 may be a repetitive step, used whenever the machine may be adjusted, for example between runs of different size products, after any time period or event which seems to indicate the machine may be out of adjustment, etc.

Spray 1008 may be the normal production process, without further reference to the newly installed structure.

Throughout this application, various publications, patents, and/or patent applications are referenced in order to more fully describe the state of the art to which this invention pertains. The disclosures of these publications, patents, and/or patent applications are herein incorporated by reference in their entireties, and for the subject matter for which they are specifically referenced in the same or a prior sentence, to the same extent as if each independent publication, patent, and/or patent application was specifically and individually indicated to be incorporated by reference.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. A method of adjusting a spray gun having a nozzle end and a rear end/feed body, the method comprising:

maintaining such nozzle end fixed in a first location defined by a vertical coordinate X1 and a horizontal coordinate X2;

rotating such spray gun about the first location (X1, X2) whereby:

such rear end/feed body moves in space while such nozzle end remains at the first location (X1, X2).

* * * * *